US006766868B2

(12) United States Patent
Frauhammer et al.

(10) Patent No.: US 6,766,868 B2
(45) Date of Patent: Jul. 27, 2004

(54) ELECTRIC COMBINATION HAMMER-DRILL

(75) Inventors: Karl Frauhammer, Leinfelden-Echterdingen (DE); Heinz Schnerring, Dettenhausen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/088,220

(22) PCT Filed: May 23, 2001

(86) PCT No.: PCT/DE01/01962

§ 371 (c)(1),
(2), (4) Date: Jul. 17, 2002

(87) PCT Pub. No.: WO02/06015

PCT Pub. Date: Jan. 24, 2002

(65) Prior Publication Data

US 2003/0037937 A1 Feb. 27, 2003

(30) Foreign Application Priority Data

Jul. 18, 2000 (DE) ..... 100 34 768

(51) Int. Cl.[7] ..... E02D 7/02
(52) U.S. Cl. ..... 173/48; 173/4; 173/162.2
(58) Field of Search ..... 173/2, 4, 47, 48, 173/162.2

(56) References Cited

U.S. PATENT DOCUMENTS 1,356,556 A * 10/1920 Payne ..... 173/48
4,204,580 A * 5/1980 Nalley ..... 173/48
4,342,931 A * 8/1982 Grossmann et al. ..... 173/48
4,348,603 A * 9/1982 Huber ..... 173/48
4,506,743 A * 3/1985 Grossmann ..... 173/48
4,998,588 A * 3/1991 Manschitz ..... 173/47
5,697,456 A * 12/1997 Radle et al. ..... 173/162.2
6,123,158 A * 9/2000 Steffen ..... 173/217

FOREIGN PATENT DOCUMENTS

DE 19720947 12/1997
EP 1075905 2/2001
WO WO 88/01219 * 2/1988 ..... 173/48

* cited by examiner

*Primary Examiner*—Stephen F. Gerrity
(74) *Attorney, Agent, or Firm*—Kenyon & Kenyon

(57) ABSTRACT

An electric combination hammer for use either as a drilling hammer or as a chisel hammer has a housing and a handle arranged on it. The housing has arranged on it an on-off switch having a pawl and a switch element for manually switching from drilling operation to chisel operation and vice versa. Also arranged is a catch device by which the pawl may be engaged in chisel operation and which also prevents a latched position from being engaged in drilling operation. The catch device has a catch bracket having two legs which are connected by a joint and may be brought into operative connection with a blocking element that blocks the joint in at least one pivot direction to establish the catch function. The catch device also has at least one catch element which may be brought into operative connection with another catch element that is in operative connection with the pawl.

8 Claims, 4 Drawing Sheets

ELECTRIC COMBINATION HAMMER-DRILL

FIELD OF THE INVENTION

The present invention relates to an electric combination hammer.

BACKGROUND INFORMATION

Published German Patent Application 197 20 947 A1 describes a generic electric combination hammer for use either as a drilling hammer or as a chisel hammer. The electric combination hammer has a housing having an electric motor by which a tool mounted in a tool mount may be driven. A bracket-shaped handle is integrally molded in one piece onto the housing on a side facing away from the tool. A pawl for operating an electric on-off switch for the electric motor is situated on a side of the handle facing the housing. The pawl is designed as an operating rocker having two rocker arms attached to the handle so it is pivotable about a pivot axis, a contact pin of the on-off switch being applied to the lower rocker arm under the force of a spring.

In chisel operation, the pawl may be locked in a latched position by a catch device. In drilling operation, however, a latched position is prevented. The catch device has a first catch element situated on the pawl and a second catch element situated on a pivot lever that is mounted on the housing by an articulated joint. The pivot lever is linked to a cam situated on a switch knob for switching manually from drilling to chisel operation and vice versa, and the pivot lever presses on its periphery by a compression spring. In a switch position of the switch knob for setting the tool for drilling operation, the catch element situated on the pivot lever is outside a contact travel of the catch element situated on the pawl. In a switch position of the switch knob which sets the tool for chisel operation, the pivot lever is pushed over the cam with its catch element into the contact travel of the catch element situated on the pawl. The catch element attached to the pawl is formed by a part which forms a catch spring having on its free end a peak which is able to engage in the catch element formed by a catch depression in the pivot lever in chisel operation.

SUMMARY OF THE INVENTION

The present invention is based on an electric combination hammer for use either as a drilling hammer or as a chisel hammer having a housing and a handle arranged on it, in which is arranged an on-off switch having a pawl and having a switch element for manually switching from drilling operation to chisel operation and vice versa and having a catch device by which the pawl may be engaged in chisel operation and which prevents a latched position from being engaged in drilling operation.

The catch device has a catch bracket having two legs which are connected by a joint and may be brought into an operative connection with a blocking element that blocks the joint in at least one pivot direction to establish the catch function and having at least one catch element which may be brought into operative connection with a catch element that is in operative connection with the pawl. The catch device may have a simple design, friction may be avoided in drilling operation and the catch bracket may have a flexible arrangement. In particular, the catch bracket may be mounted in the handle in a simple design in the case of a movably mounted handle, thus preventing any relative movement, caused by a movement of the handle, between the corresponding catch elements and unwanted release of the catch connection.

The blocking element is advantageously mounted on the housing and its movement may be controlled by the switching element. If the handle is connected to the housing by a joint at a first end and by an isolation device at a second end, and if the catch bracket is mounted on the side of the handle facing the joint, then it is possible to minimize any relative movement between the blocking element mounted on the housing and the catch bracket, as well as the resulting friction and wear.

The blocking element may be designed to be purely mechanically controllable by the switch element, e.g., by having the blocking element in operative connection with the switch element by way of a switch lever, or it may be designed to be controlled electrically by the switch element. With an electric control, a mechanical connection between the switch element and the blocking element may be avoided, and parts, space, weight, assembly, complexity and cost may be saved. Furthermore, degrees of freedom in design may also be created. The blocking element may be designed to be operable by an electric motor or by an electromagnetic actuator, which is especially advantageous. A corresponding electromagnetic actuator may be simple in design and inexpensive.

To save on parts, space, weight and assembly complexity, a controller for controlling the blocking element is advantageously designed at least partially, preferably completely, in one piece with a controller for controlling the change from drilling operation to chisel operation and vice versa. Furthermore, parts, space and weight may be saved by designing at least one catch element in one piece with a catch spring and/or at least one leg of the catch bracket in one piece with a catch element.

DETAILED DESCRIPTION

Figure 1:
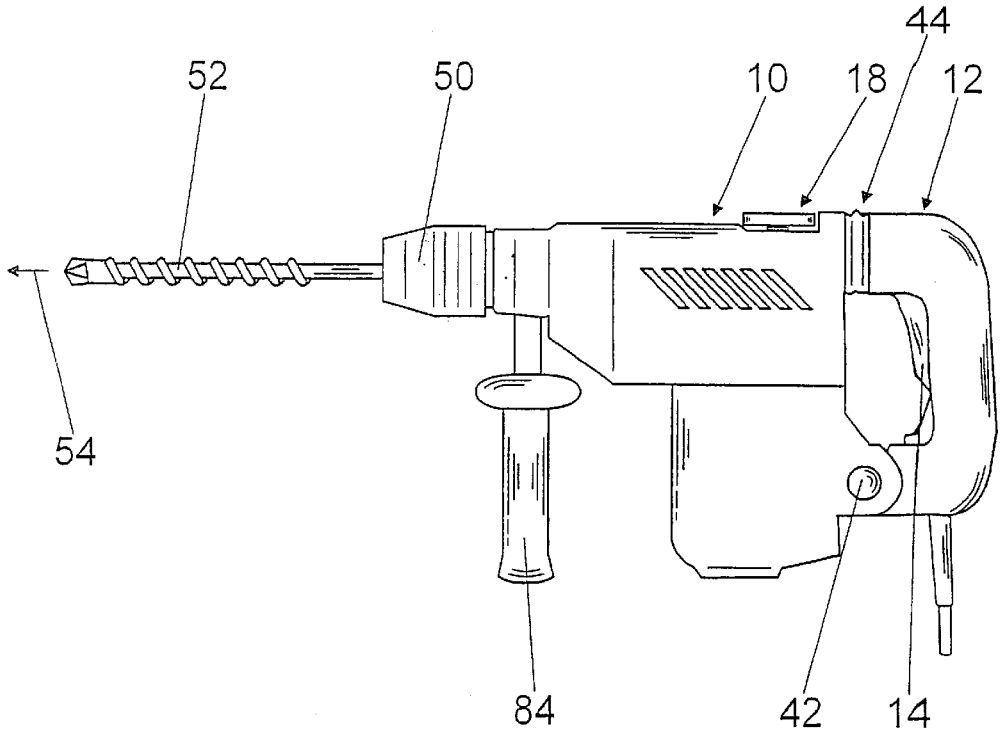
FIG. 1 shows a schematic diagram of an electric combination hammer.

FIG. 1 shows an electric combination hammer for use either as a drilling hammer or as a chisel hammer having an electric motor (not shown in greater detail) in a housing 10 and a drive and a beater mechanism by which a tool 52 clamped in a tool mount 50 may be driven to rotate and to beat. A first handle 84 extending perpendicular to direction of actuation or operation 54 is mounted on housing 10 opposite direction of operation 54 after tool mount 50.

A second bracket-shaped handle 12 extending perpendicular to direction of operation 54 is situated on a side of housing 10 facing away from tool 52 and is connected at a first end facing away from a tool axis by a joint 42 to housing 10 with a pivot axis running across direction of operation 54. Handle 12 is connected to housing 10 at a second end via an isolation device 44.

Isolation device 44 has a helical compression spring 56 for vibration isolation (FIGS. 2 and 3) under bias tension by way of a tension and holding device (not shown in greater detail) which connects handle 12 and housing 10. Helical compression spring 56 acts with its first end on handle 12 and is supported at its second end on housing 10. Helical compression spring 56 and a spring space surrounding helical compression spring 56 are shielded from the outside by a rubber sleeve 58 and are thus protected from soiling.

On a side facing tool 52 is situated a pawl 14 which is designed as a rocker on handle 12 and is connected to handle 12 by an articulated joint 60 having a pivot axis running across direction of actuation 54. An operator may operate an electric on-off switch 16 integrated into handle 12 by way of pawl 14. Pawl 14 is loaded by a compression spring 62 in the direction of tool 52 on the side of joint 60 facing isolation device 44, namely being loaded in the direction of a starting position in which the electric combination hammer is turned off.

A knob 18 having an axis of rotation perpendicular to direction of actuation 54 is situated on a cover side of the electric combination hammer for manual switching from drilling operation to chisel operation and vice versa. A cam 64 is integrally molded on knob 18 on the side facing housing 10, establishing an operative connection between knob 18 and a pivot lever 32 of a catch device 20 running parallel to handle 12. Pivot lever 32 is pivotably mounted on housing 10 by a joint 68 having a pivot axis across direction of actuation 54. On the side of joint 68 facing away from knob 18, pivot lever 32 is loaded by a compression spring 70 in the direction of handle 12 and is pressed against cam 64 by a compression spring 70 with the end facing knob 18 having an end face of a leg 72 integrally molded on and extending in the direction of actuation 54.

Figure 2:
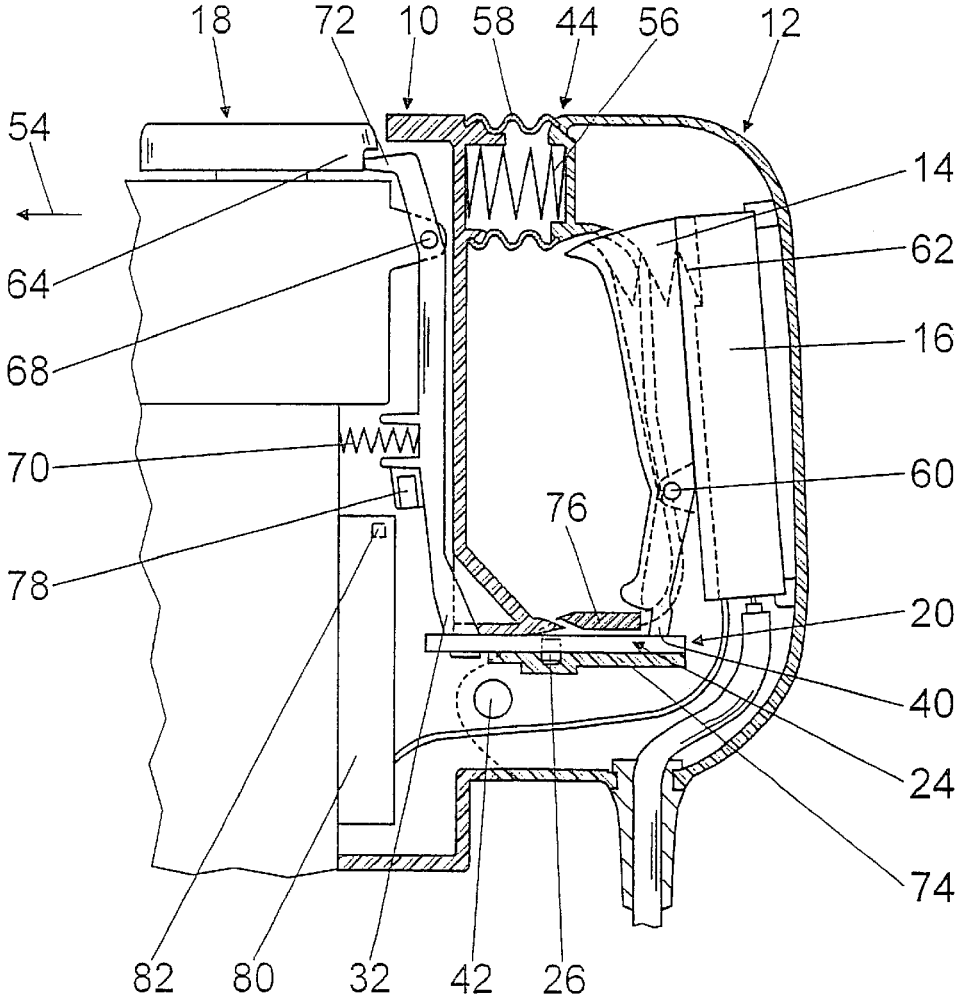
FIG. 2 shows a longitudinal section through a handle from FIG. 1 having an engaged pawl in chisel operation.
Figure 3:
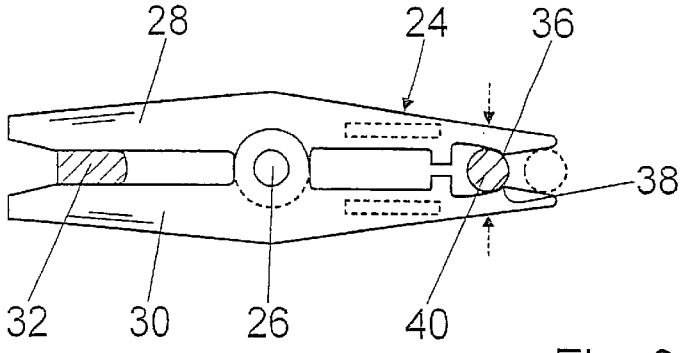
FIG. 3 shows an enlarged diagram of a catch bracket from FIG. 2 as seen from the top.

According to the present invention, catch device 20 has a catch bracket 24 having two legs 28, 30 which extend in the longitudinal direction of the electric combination hammer and are connected by a joint 26 and may be brought into an operative connection with an end of pivot lever 32 which faces joint 42 on handle 12 to establish the catch function (FIGS. 2 and 3). Catch elements 36, 38 formed by projections are integrally molded in one piece on the ends of legs 28, 30 on their insides on the side of joint 26 of catch bracket 24 facing handle 12 and opposite pivot lever 32.

Catch bracket 24 is mounted in handle 12 on the side facing joint 42 of handle 12 or it may be mounted directly by way of joint 42, and legs 28, 30 which are guided in their pivoting movements by way of two guides 74, 76 on handle 12.

FIG. 2 illustrates the electric combination hammer in chisel operation using an engaged pawl 14. With its smaller diameter radially, cam 64 faces in the direction of handle 12. Pivot lever 32 is pushed by compression spring 70 between legs 28, 30, with its end pointing toward joint 42 of handle 12, blocking them in their pivoting movement on the side facing pivot lever 32 toward the inside or toward the outside on the side facing handle 12.

Pawl 14 is pushed back against compression spring 62 in the direction opposite to the direction of actuation 54 on the side facing isolation device 44, i.e., when the electric combination hammer is activated. On an end of pawl 14, facing away from isolating device 44, a bolt-shaped catch element 40 is integrally molded, and with deflection from pawl 14 it is pushed between legs 28, 30 for activation of the electric combination hammer. Legs 28, 30 are then deflected elastically outward. When bolt-shaped catch element 40 has crossed the area of catch elements 36, 38 of legs 28, 30, legs 28, 30 snap inward, thus engaging with their catch elements 36, 38 the bolt-shaped catch element 40 which is integrally molded on pawl 14 from behind. Pawl 14 is thus locked in place.

Legs 28, 30 are made of an elastic plastic and form catch springs of catch device 20. Legs 28, 30 are designed with respect to elasticity and shaping so that catch element 40 is held securely during chisel operation despite the restoring force of compression spring 62 and may be released by an operator by depressing pawl 14 on the side of joint 60 facing catch bracket 24 against direction of operation 54.

Figure 4:
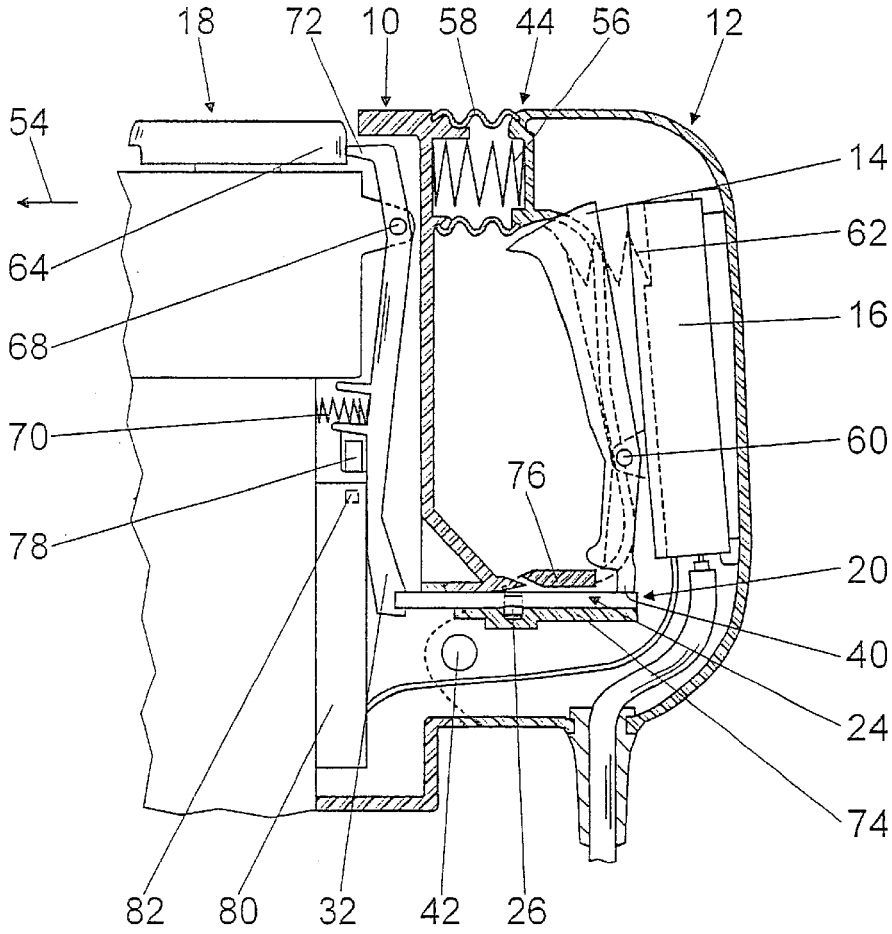
FIG. 4 shows the handle from FIG. 2 in drilling operation.
Figure 5:
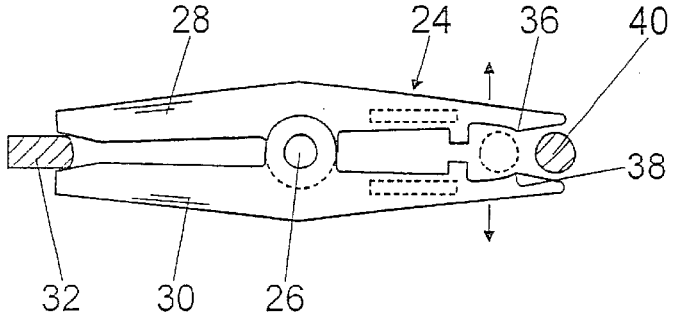
FIG. 5 shows an enlarged diagram of the catch bracket from FIG. 4 as seen from the top.

If knob 18 has been set to drilling operation, then leg 72 of pivot lever 32 is pivoted by cam 64 in the direction of handle 12, so that pivot lever 32 together with its end which faces catch bracket 24 is pivoted in the direction of controller 80 so that the blocking of legs 28, 30 by pivot lever 32 is canceled and legs 28, 30 may be pivoted outward on the side facing handle 12 (FIGS. 4 and 5). Catch element 40, which is integrally molded on pawl 14, is capable of moving freely due to catch elements 36, 38 of catch bracket 24. Engagement of pawl 14 and friction between catch element 40 of pawl 14 and catch elements 36, 38 of catch bracket 24 are prevented.

In addition, a permanent magnet 78 is attached to pivot lever 32 and may be brought into operative connection with a Hall sensor 82 integrated into an electronic controller 80.

If knob 18 has been set to chisel operation, then permanent magnet 78 is in front of Hall sensor 82 in direction of actuation 54 (FIGS. 2 and 3). An effect of permanent magnet 78 on Hall sensor 82 is prevented, so that the power of the electric combination hammer for chisel operation is increased by a change in resistance via electronic controller 80.

When knob 18 is set to drilling operation, permanent magnet 78 is above Hall sensor 82 (FIGS. 4 and 5). Permanent magnet 78 acts on Hall sensor 82, so that the power of the electric combination hammer for drilling operation is reduced by a change in resistance via electronic controller 80.

Figure 6:
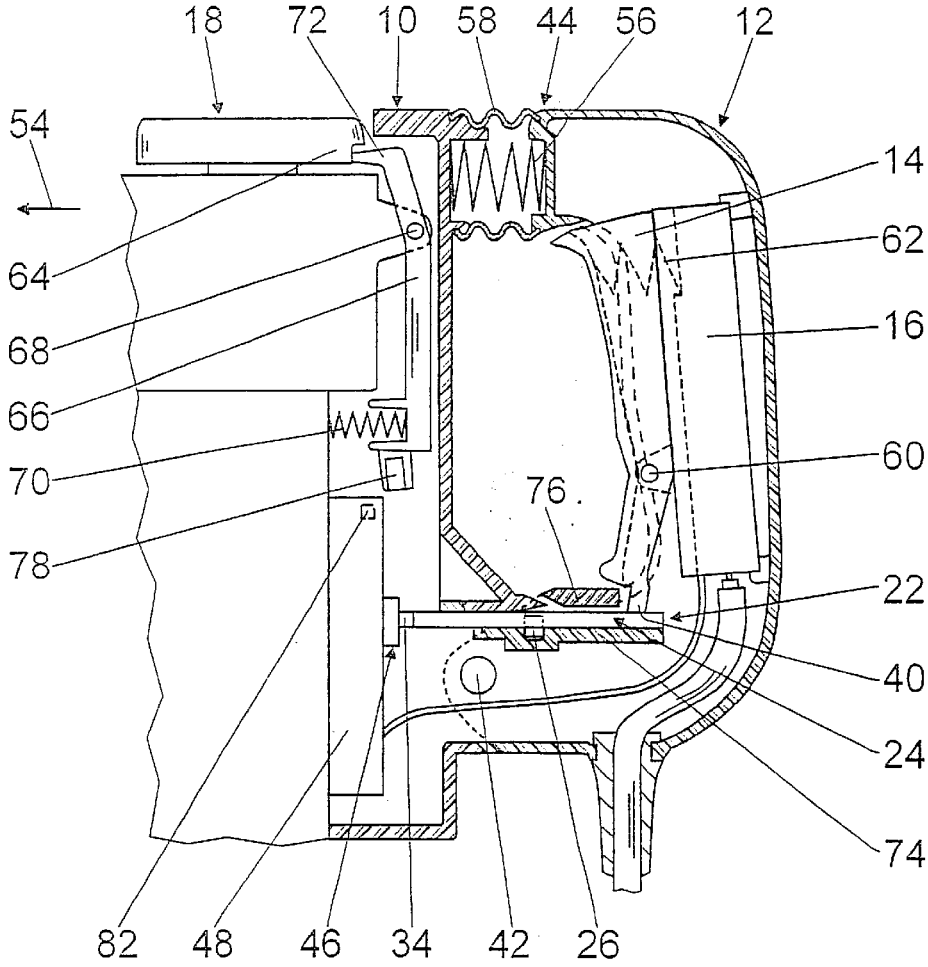
FIG. 6 shows a variant of FIG. 2 having an electromagnetic actuator.
Figure 7:
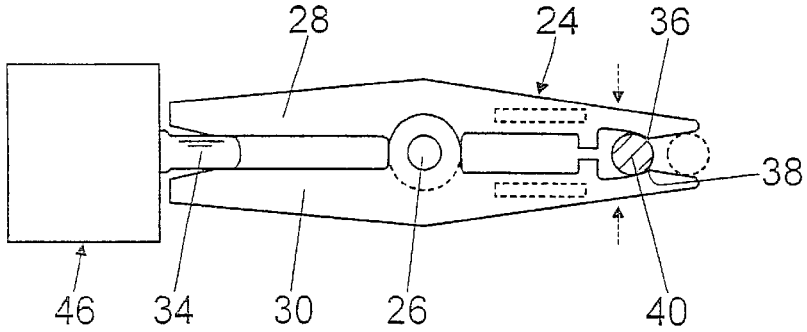
FIG. 7 shows an enlarged diagram of a catch bracket from FIG. 6 as seen from the top.

FIGS. 6 and 7 illustrate a variant of the embodiment in FIGS. 1 through 5. Parts that remain essentially the same are labeled with essentially the same reference numbers. Furthermore, with regard to features and functions that remain the same, reference may be made to the description of the embodiment in FIGS. 1 through 5. The following description is limited essentially to the differences in comparison with the embodiment in FIGS. 1 through 5.

The embodiment in FIGS. 6 and 7 has a catch device 22 having an electromagnetic actuator 46 by which a lift rod 34 is displaceable between two legs 28, 30 of a catch bracket 24 to block it in its pivoting motion toward the outside for a catch function on a side facing a handle 12. Electromagnetic actuator 46 is controlled electrically by an electronic controller 48, namely via a permanent magnet 78 and a Hall sensor 82 which are also used to control the power of the electric combination hammer for chisel operation and drilling operation via electric controller 48. Hall sensor 82 is integrated into electronic controller 48, and the permanent magnet 78 is mounted on a pivot lever 66 which is operated by a knob 18 corresponding to pivot lever 32 in the embodiment illustrated in FIGS. 1 through 5.

If knob 18 is set to chisel operation, then permanent magnet 78 is in front of Hall sensor 82 in direction of actuation 54. An effect of permanent magnet 78 on Hall sensor 82 is prevented, so that the power of the electric combination hammer for chisel operation is increased by a change in resistance via electronic controller 48 and lift rod 34 is displaced by electromagnetic actuator 46 between two legs 28, 30 of catch bracket 24 to block it in its pivoting motion for the catch function.

When knob 18 is set to drilling operation, permanent magnet 78 is above Hall sensor 82. Permanent magnet 78 acts on Hall sensor 82 so that electronic controller 48 reduces the power of the electric combination hammer for drilling operation by a change in resistance, and lift rod 34 is displaced by electromagnetic actuator 46 in the direction of housing 10, and the blocking of legs 28, 30 by lift rod 34 is canceled so that legs 28, 30 may be pivoted outward on the side facing a pawl 14. A catch element 40 integrally molded on pawl 14 is able to move freely due to two catch elements 36, 38 of catch bracket 24. Engagement of pawl 14 and friction between catch element 40 of the pawl and catch elements 36, 38 of catch bracket 24 are prevented. In addition to the control functions of permanent magnet 78 and Hall sensor 82 as described here, other control functions which seem appropriate to those skilled in the art are also conceivable.

What is claimed is:

1. An electric combination hammer for use as one of a drilling hammer and a chisel hammer, comprising:

a housing;

a handle arranged on the housing;

an on-off switch linked to a pawl arranged in the handle;

a switch element for one of manually switching from drilling operation to chisel operation and manually switching from chisel operation to drilling operation; and a catch device by which the pawl is adapted to be engaged in chisel operation and which prevents a latched position from being engaged in drilling operation, wherein the catch device has a catch bracket having two legs which are connected by a joint and adapted to be brought into operative connection with a blocking element that blocks the joint in at least one pivot direction to establish the catch function, and at least one catch element which is adapted to be brought into operative connection with another catch element which is in operative connection with the pawl.

2. The electric combination hammer according to claim 1, wherein handle is movably mounted and the catch bracket is mounted in the handle.

3. The electric combination hammer according to claim 2, wherein the handle is connected to the housing by a joint at a first end and by an isolation device at a second end, and wherein the catch bracket is mounted on the side of the handle facing the joint.

4. The electric combination hammer according to claim 1, wherein the blocking element is electrically drivable.

5. The electric combination hammer according to claim 4, wherein the blocking element is operable by an electromagnetic actuator.

6. The electric combination hammer according to claim 4, further comprising a controller for controlling the blocking element and controlling the change from one of drilling operation to chisel operation and chisel operation to drilling operation.

7. The electric combination hammer according to claim 1, further comprising a catch spring, wherein the at least one catch element is formed in one piece with the catch spring.

8. The electric combination hammer according to claim 1, wherein at least one leg of the catch bracket is formed in one piece with the at least one catch element.

* * * * *